US011668467B2

(12) United States Patent
DeSpain

(10) Patent No.: US 11,668,467 B2
(45) Date of Patent: Jun. 6, 2023

(54) STOVE WITH MULTIPLE CONFIGURATIONS

(71) Applicant: Firebox Outdoors LLP, Moroni, UT (US)

(72) Inventor: Steven S. DeSpain, Moroni, UT (US)

(73) Assignee: Firebox Outdoors LLP, Moroni, UT (US)

( * ) Notice: Subject to any disclaimer, the term of this patent is extended or adjusted under 35 U.S.C. 154(b) by 0 days.

(21) Appl. No.: 16/731,782

(22) Filed: Dec. 31, 2019

(65) Prior Publication Data

US 2020/0132307 A1 Apr. 30, 2020

Related U.S. Application Data

(62) Division of application No. 15/849,048, filed on Dec. 20, 2017, now Pat. No. 10,712,010.

(60) Provisional application No. 62/437,459, filed on Dec. 21, 2016.

(51) Int. Cl.
*F24B 1/02* (2006.01)
*F24C 1/16* (2021.01)

(52) U.S. Cl.
CPC ..... *F24B 1/022* (2013.01); *F24C 1/16* (2013.01)

(58) Field of Classification Search
CPC ..... F24B 1/205
See application file for complete search history.

(56) References Cited

U.S. PATENT DOCUMENTS

| | | | | |
|---|---|---|---|---|
| 2,789,608 | A * | 4/1957 | Tupper | B65D 51/246 220/792 |
| 3,851,639 | A | 12/1974 | Beddoe | |
| 4,185,748 | A | 1/1980 | Vache et al. | |
| 5,042,451 | A | 8/1991 | Beller | |
| 5,312,011 | A * | 5/1994 | Fischer | B65D 21/022 206/508 |
| 5,535,733 | A * | 7/1996 | Hait | A47J 37/0704 126/25 R |
| 2014/0299005 | A1* | 10/2014 | Vinett | A23B 4/052 99/482 |
| 2014/0360385 | A1 | 12/2014 | Cammon | |
| 2015/0004297 | A1 | 1/2015 | Pothetes | |
| 2016/0245529 | A1* | 8/2016 | McClean | F24B 1/022 |

FOREIGN PATENT DOCUMENTS

CA 1162439 A 2/1984

* cited by examiner

*Primary Examiner* — Jason Lau
(74) *Attorney, Agent, or Firm* — Brake Hughes Bellermann LLP

(57) ABSTRACT

In one aspect, a stove can include a first cover including a cavity, and a second cover including a cavity. The stove can include a main portion including a first end portion and a second end portion. The first end portion can define a first opening and the second end portion define a second opening. In a stowed configuration, the first end portion of the main portion can be disposed in the cavity of the first cover and the second end portion of the main portion can be disposed in the cavity of the second cover. In a deployed configuration, the second cover can be arranged so that the cavity of the second cover is facing in a downward direction away from the main portion.

20 Claims, 15 Drawing Sheets

STOVE WITH MULTIPLE CONFIGURATIONS

RELATED APPLICATIONS

This application is a divisional of, and claims priority to, U.S. patent application Ser. No. 15/849,048, filed on Dec. 20, 2017, entitled "STOVE WITH MULTIPLE CONFIGURATIONS," which claims priority to and the benefit of U.S. Provisional Application No. 62/437,459, filed Dec. 21, 2016, entitled "STOVE WITH MULTIPLE CONFIGURATIONS", the disclosures of which are incorporated herein by reference in their entireties.

TECHNICAL FIELD

This description generally relates to a stove having multiple configurations.

BACKGROUND

Portable stoves come in a variety of designs for different uses (e.g., camping, outdoor sporting events, picnicking, backpacking, or other use in remote locations where an easily transportable means of cooking or heating is needed). Most stoves have the same configuration in a stowed position (e.g., stored, packaged) and in a deployed position (e.g., in use), and therefore, the stove can be burdensome and difficult when storing and/or carrying the stove.

SUMMARY

In one aspect, a stove can include a first cover including a cavity, and a second cover including a cavity. The stove can include a main portion including a first end portion and a second end portion. The first end portion can define a first opening and the second end portion define a second opening. In a stowed configuration, the first end portion of the main portion can be disposed in the cavity of the first cover and the second end portion of the main portion can be disposed in the cavity of the second cover. In a deployed configuration, the second cover can be arranged so that the cavity of the second cover is facing in a downward direction away from the main portion.

BRIEF DESCRIPTION OF THE DRAWINGS

The details of one or more implementations are set forth in the accompanying drawings and the description below. Other features will be apparent from the description and drawings, and from the claims.

Like reference symbols in the various drawings indicate like elements.

DETAILED DESCRIPTION

Figure 1A:
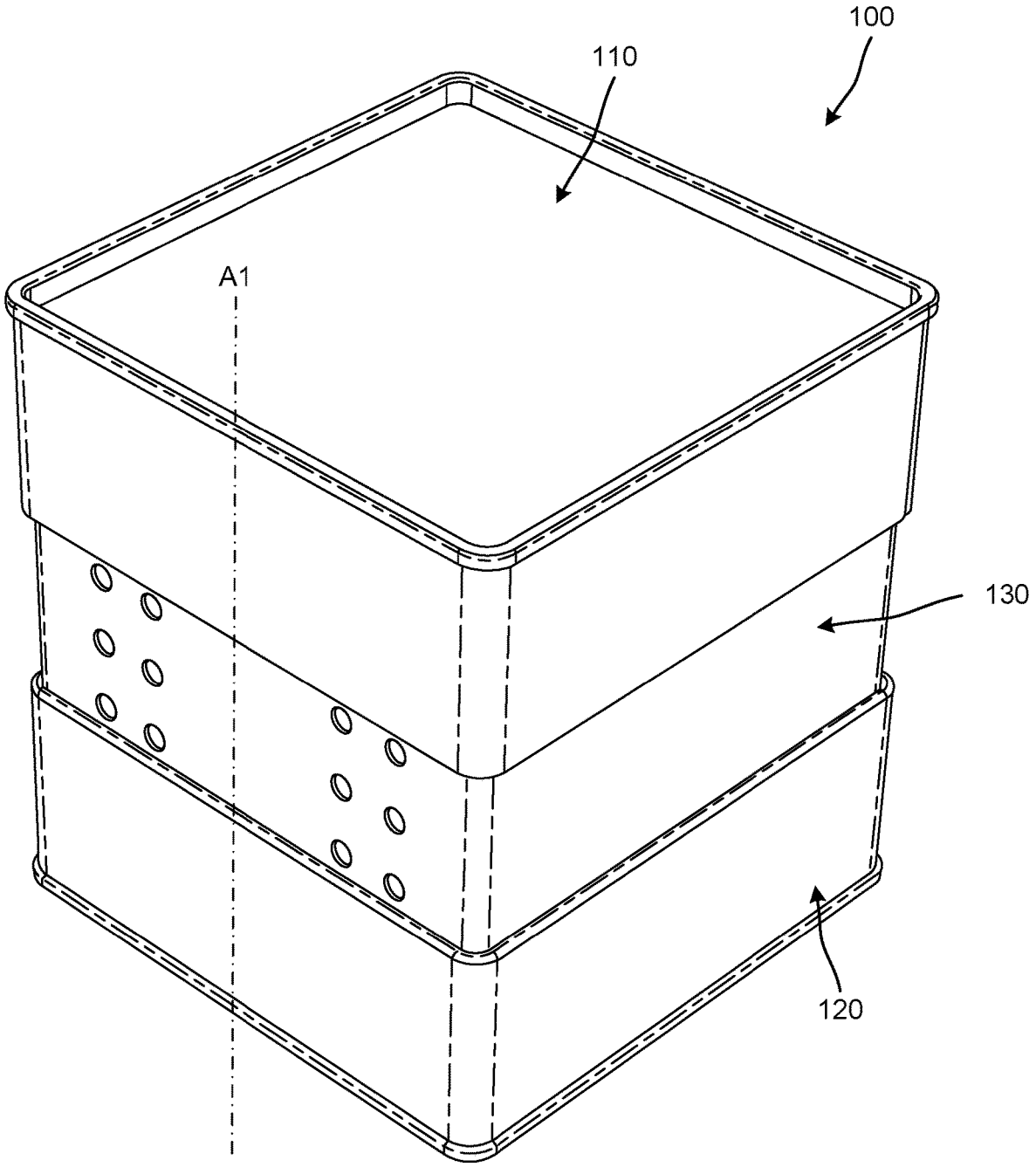
FIG. 1A is a diagram that illustrates a perspective view of a stove in accordance with an example implementation.

FIGS. 1A through 1J illustrate various views and components of a stove 100, according to example implementations. The stove 100 includes a first cover 110 (e.g., top cover), a second cover 120 (e.g., bottom cover), and a main portion 130. The first cover 110 and the second cover 120 each include a cavity (labeled as 111 and 121 in at least in FIG. 1B (in several views the interior of the cavity may not be visible)) into which the main portion 130 can be disposed therein. Specifically, a first end portion 131 (labeled in at least in FIG. 1B) of the main portion 130 can be disposed in the first cover 110 and a second end portion 132 (labeled in at least in FIG. 1B) of the main portion 130 can be disposed in the second cover 120. In this configuration, the stove 100 has a compact design and may be, for example, easier to carry to remote locations.

Although the first cover 110 and the second cover 120 are shown and described as different components, in some implementations, the first cover 110 can be the same (e.g., can have the same shape and/or function) as the second cover 120. In some implementations, the first cover 110 can have a different function and/or shape than the second cover 120, and vice versa.

The stove 100 can be configured to change from multiple configurations (e.g., stowed configuration, multiple deployed configurations) and can be configured to use a variety of fuels (e.g., a fuel stick, a fuel disc, a fire starter (e.g., paraffin wax starter), alcohol, gas, trangia burner with fuel, wood, charcoal, etc.). This permits a user to use other source of fuels if one fuel runs out and/or is unavailable. In some implementations, the stove 100 can be made of a variety of materials, such as, a metal (e.g., aluminum, steel, a metal alloy, etc.). In some implementations, a thickness of the material of the stove 100 can be approximately 1 mm. In some implementations, the thickness can be greater or less than 1 mm. Although not all features are described with respect to all figures, the features can be used across many of the implementations.

Figure 1B:
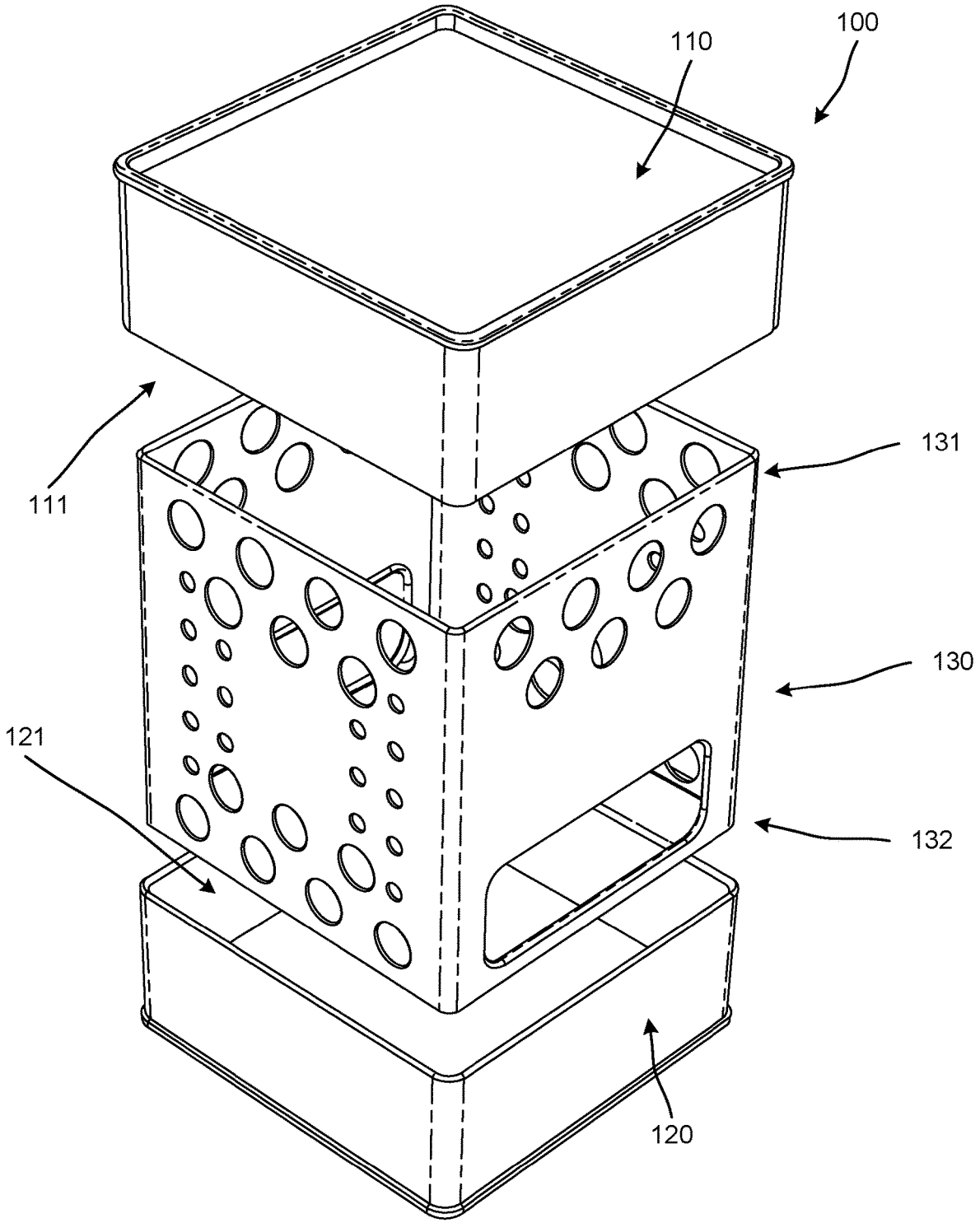
FIG. 1B is a diagram that illustrates an exploded view of the stove in accordance with an example implementation.

The stove 100 in FIG. 1A is shown in a stowed configuration with both the first and second covers 110, 112 coupled (e.g., engaged with) to the main portion 130. Specifically, a first end portion 131 of the main portion 130 is disposed in the first cover 110 and a second end portion 132 of the main portion 130 is disposed in the second cover 120 when the stove 100 is in the stowed configuration, as shown in FIG. 1B. In some implementations, when in the stowed configuration, only the first end portion 131 of the main portion 130 is disposed in the first cover 110 or the second end portion 132 of the main portion 130 is disposed in the second cover

120 when the stove 100 is in the stowed configuration. In the stowed configuration, fuel and/or other items (e.g., supplies, food, etc.) can be stored within the main portion 130.

In this implementation, the stove 100 has a square profile when viewed from above or below (as the stove 100 is oriented in at least FIG. 1A). In some implementations, the stove 100 when viewed from above or below can have a different shaped profile such as a rectangular-shaped profile, a cylindrical profile (e.g., a round-shaped, oval-shaped, elliptical-shaped), at least one edge with a curved-shaped profile, a profile with a different polygon shape, and/or so forth. The covers 110, 120 can have a shape that corresponds with the shape of the main portion 130 of the stove 100. For example, if the main portion 130 has a cylindrical shape, the covers 110, 120 can also have a cylindrical or circular shape.

In this implementation, the stove 100 has a square profile when viewed from the side (as the stove 100 is oriented in FIG. 1A). In some implementations, the stove 100 when viewed from the side can have a different shaped profile such as a square shaped profile with at least one edge with a curved shaped profile, a profile with a different polygon shape, and/or so forth.

FIG. 1B illustrates an exploded view of the stove 100, in accordance to an example implementation. A cavity 121 of the second cover 120 is shown in FIG. 1B. Although not shown in FIG. 1B, the first cover 110 also includes a cavity 111.

Figure 1C:
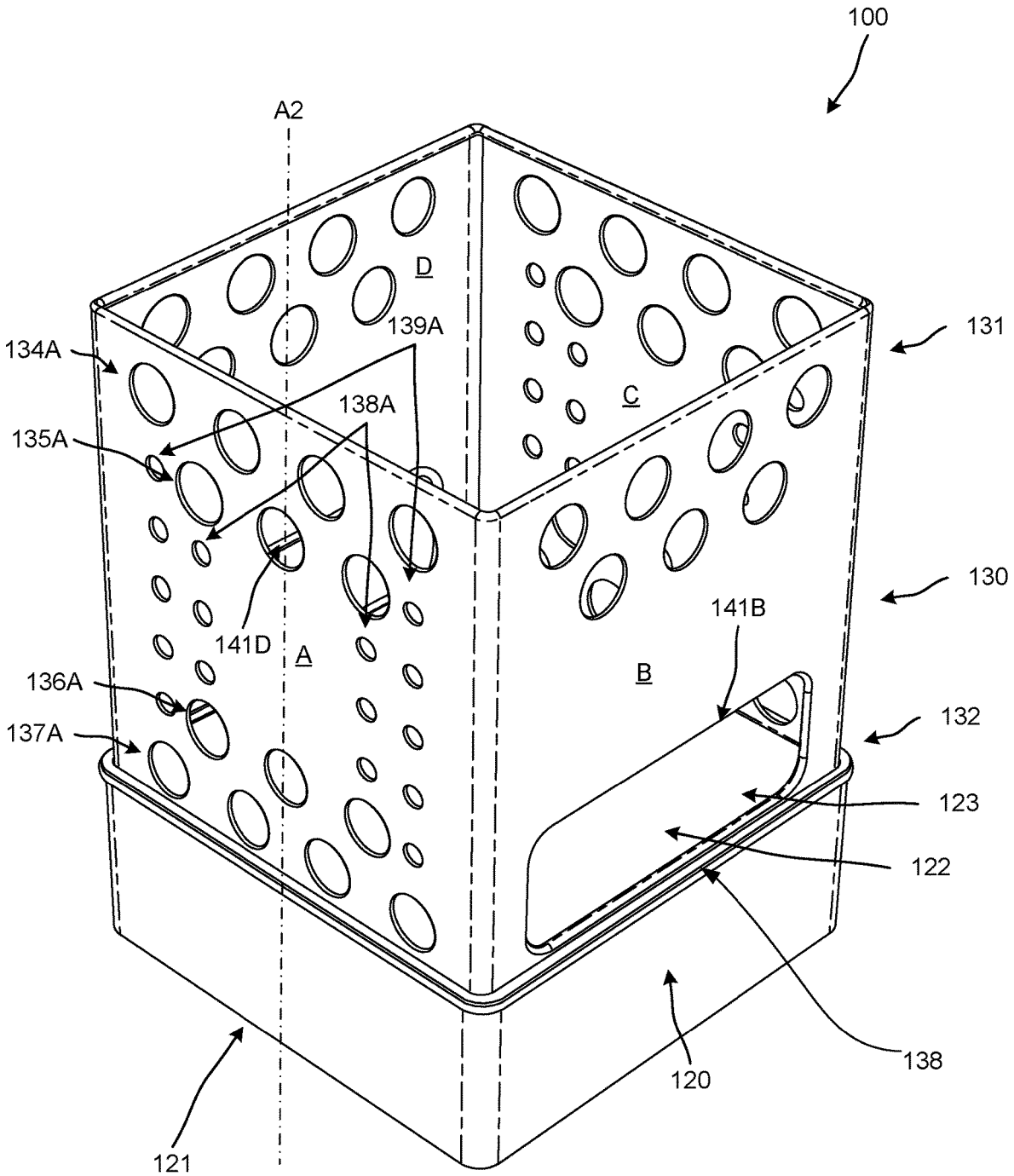
FIG. 1C is a diagram that illustrates a deployed configuration of the stove according to an example implementation.

FIG. 1C illustrates a first deployed configuration of the stove 100, in accordance to an example implementation. As shown in FIG. 1C, in the first deployed configuration, the second cover 120 is rotated (e.g., turned upside down) so that the cavity 121 is facing in a downward direction away from the main portion 130. The end portion 132 of the main portion 130 can have a surface (end surface) that can be in contact with a surface 122 (or at least a portion thereof) of the second cover 120. In other words, an end edge 138 of the main portion 130 is in contact with the surface 122 of the second cover 120. In some implementations, the end portion 132 of the main portion 130 can have a surface (end surface) that can be disposed in a recess 123 of the second cover 120. The recess 123 can be on an opposite side of the second cover 120 relative to the cavity 121. The recess 123 allows the main portion 130 to have tight fit (e.g., avoid movement) on the surface of the second cover 120. In the first deployed configuration, an item to be heated can be disposed above the main portion 130 (e.g., disposed on the main portion 130). In some implementations, a grill (not shown) may be placed on top of the main portion 130 (near the first end portion 131) to place the item on the grill and heat the item.

Figure 1D:
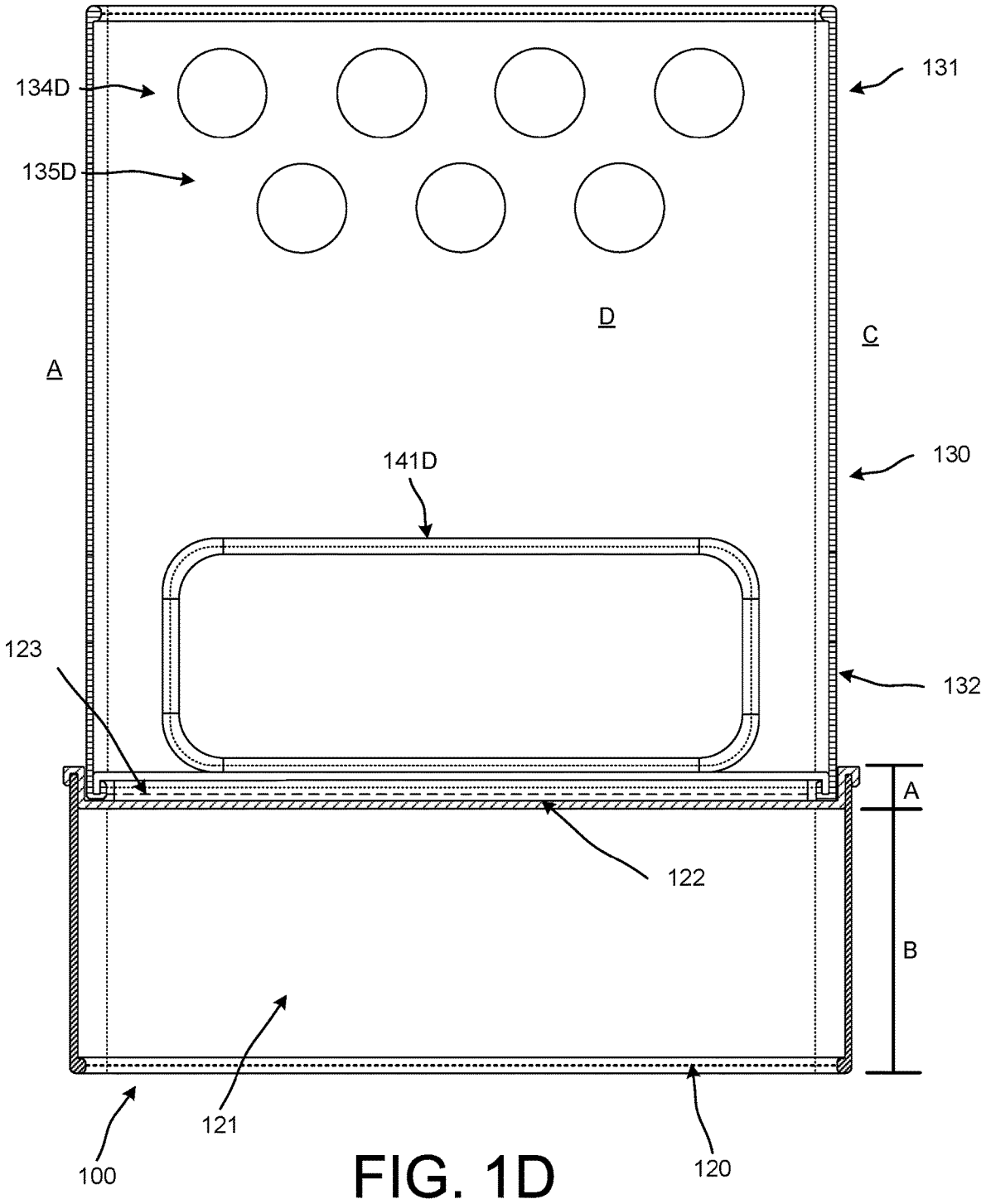
FIG. 1D is a diagram that illustrates a cross-sectional view of FIG. 1C of the stove in the deployed configuration.
Figure 1E:
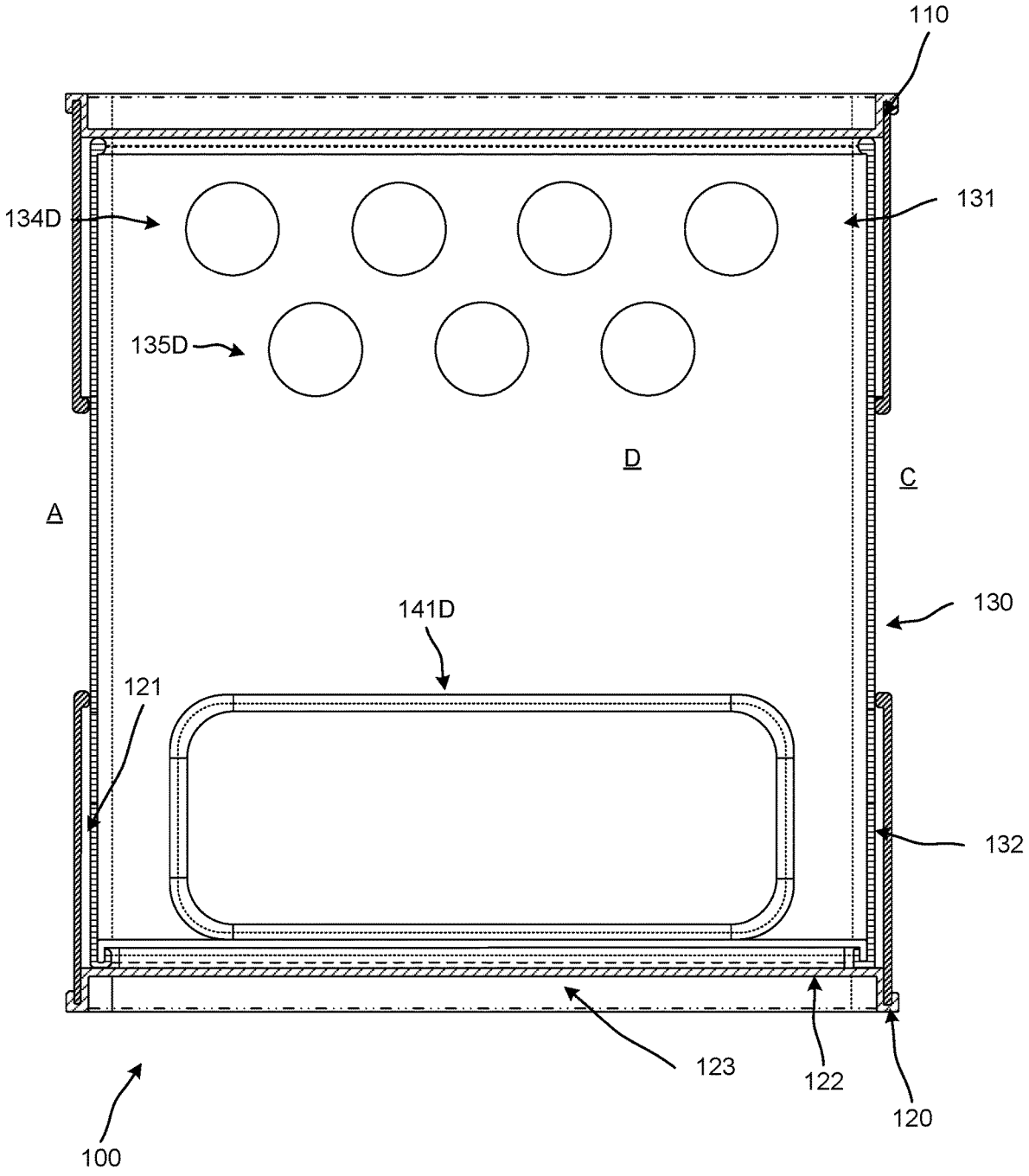
FIG. 1E is a diagram that illustrates a cross-sectional view of FIG. 1A of the stove in the stowed configuration.
Figure 1F:
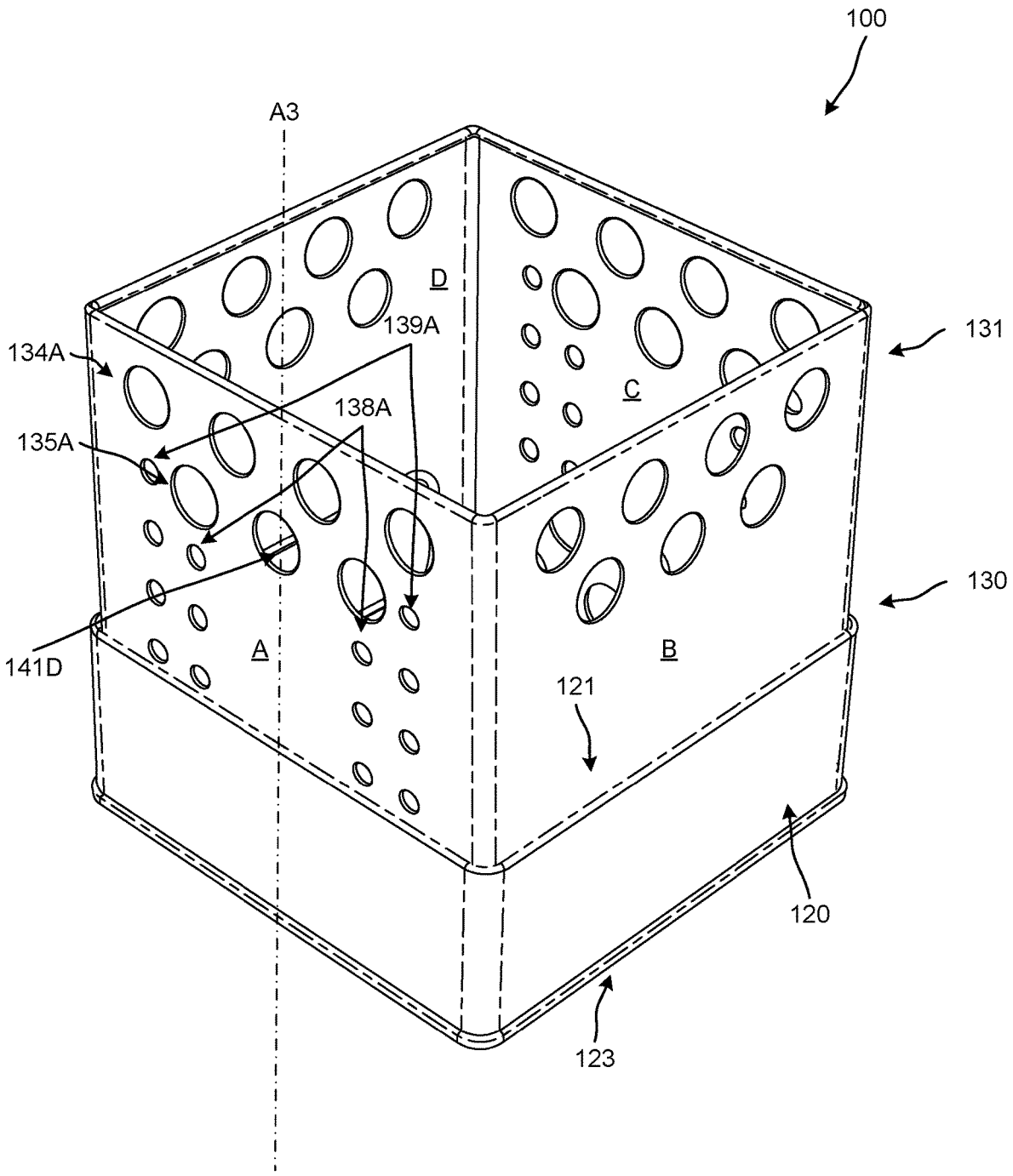
FIG. 1F is a diagram that illustrates a deployed configuration of the stove according to another example implementation.
Figure 1G:
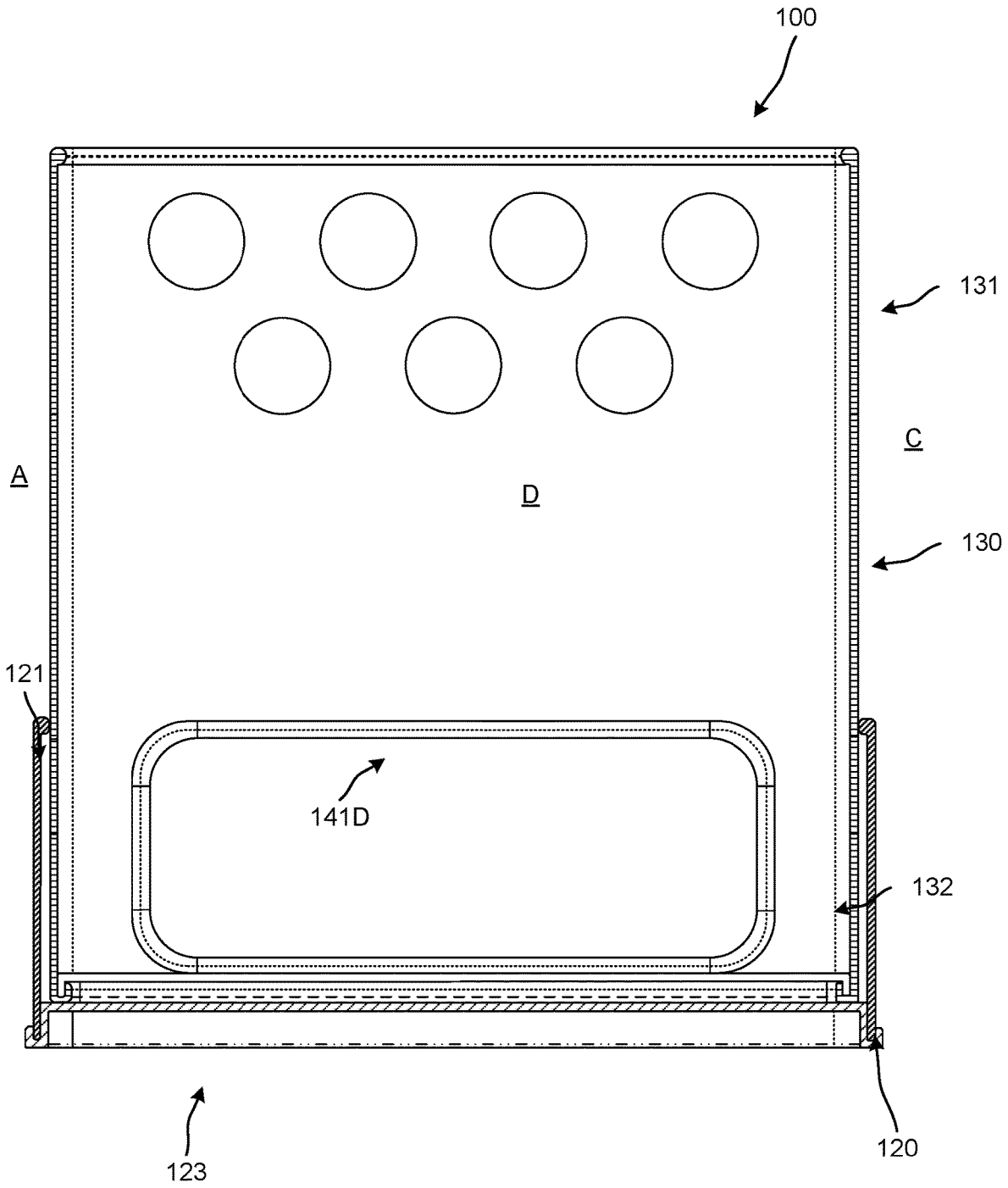
FIG. 1G is a diagram that illustrates a cross-sectional view of FIG. 1F of the stove in the deployed configuration.
Figure 1H:
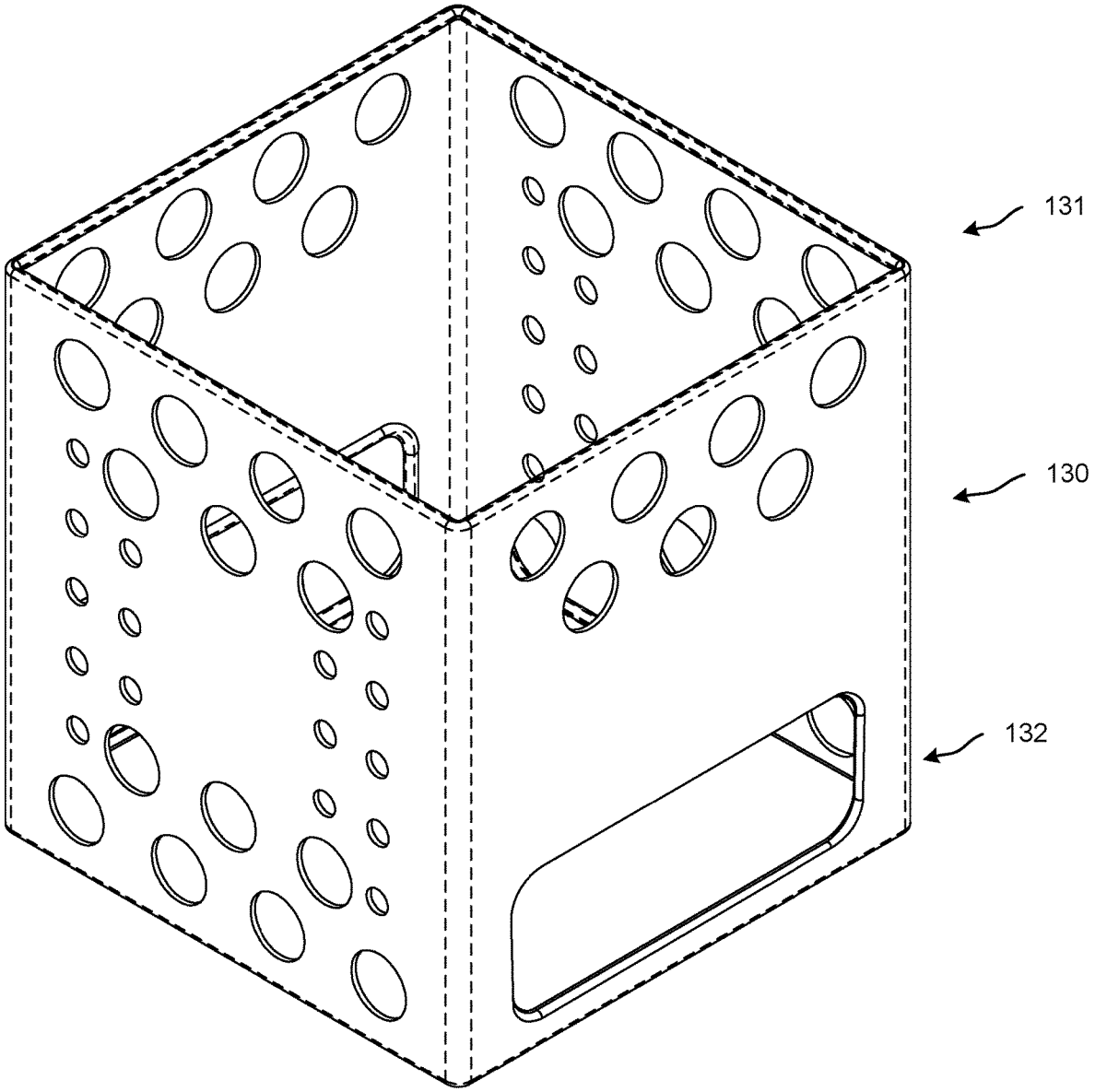
FIG. 1H is a diagram that illustrates a main portion of the stove in accordance with an example implementation.
Figure 1I:
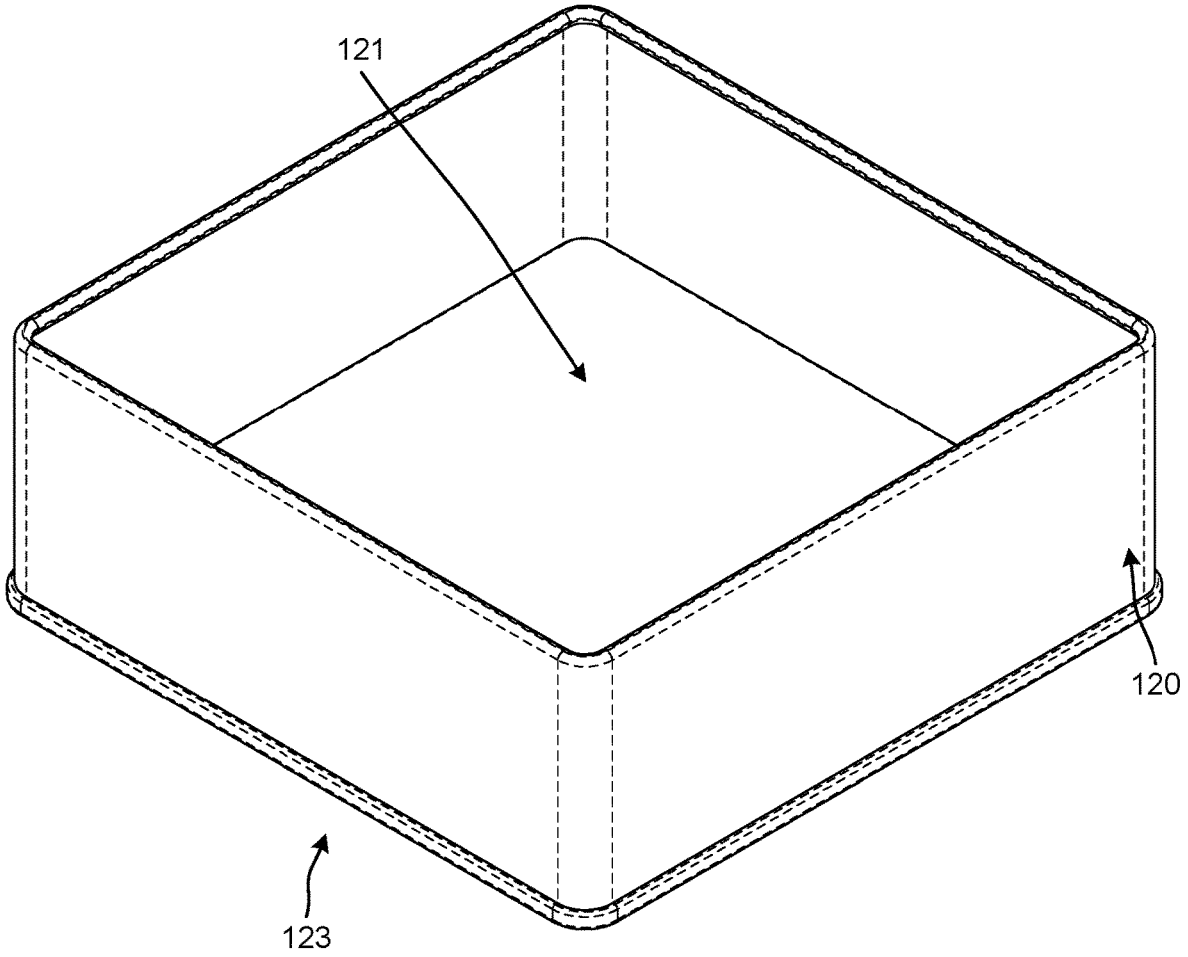
FIG. 1I is a diagram that illustrates a second cover of the stove in accordance with an example implementation.
Figure 1J:
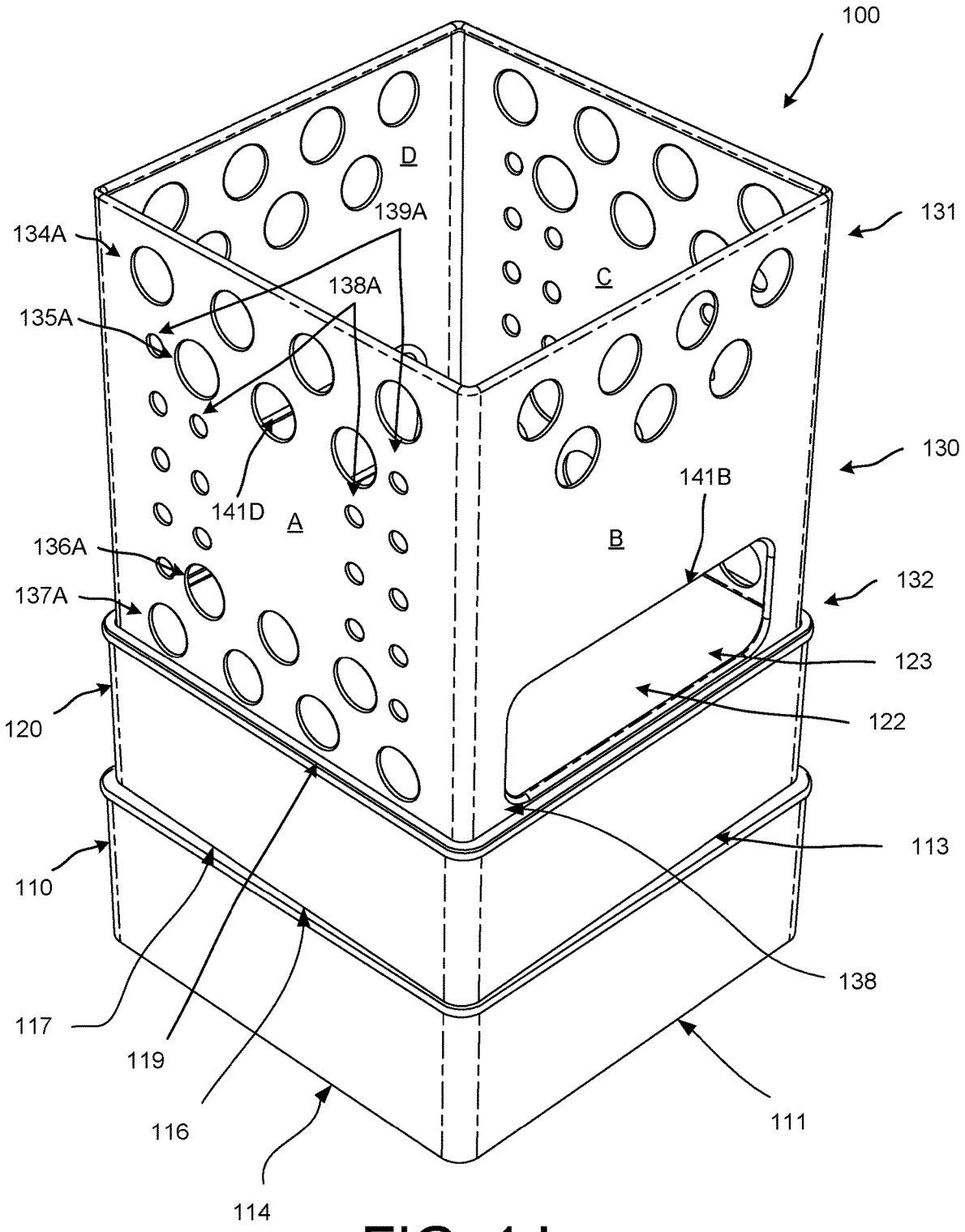
FIG. 1J is a diagram that illustrates a variation of the stove in the deployed configuration according to another example implementation.

In some implementations, the first cover 110 can similarly have a recess 113 (labeled in FIG. 1J). In this implementation, the first cover 110 can be disposed below the second cover 120 forming a stacked structure. Similarly, an end edge 117 of the second cover 120 can be in contact with a surface of the first cover 110. In other words, the end edge 117 of the second cover 120 can be disposed in the recess 113 of first cover 110.

In some implementations, the recess 123 of the second cover 120 can be shallower than the cavity 121. In other words, as shown in FIG. 1D, a depth B (e.g., distance from an end edge 117 to a surface of the second cover 120) of cavity 121 may be deeper than a depth A (e.g., distance from an end edge 116 to the surface of the second cover 120) of recess 123 of the second cover 120. Similarly, the recess 113 of the first cover 110 can be shallower than the cavity 111. In other words, a depth (e.g., distance from an end edge 114 to a surface of the first cover 110) of cavity 111 may be deeper than a depth (e.g., distance from an end edge 116 to the surface of the first cover 110) of recess 113 of the first cover 110.

As shown in FIG. 1C, the stove 100 can include two horizontal rows of holes 134A, 135A (in the end portion 131), two horizontal rows of holes 136A, 137A (in the end portion 132), inner vertical holes 138A, and outer vertical holes 139A. The holes are denoted with the letter "A" because they are on side A of the stove 100. The other sides of the stove 100 are labeled B through D. In some implementations, the inner vertical holes 138A can be disposed between rows of holes 135A and 136A. The rows of holes 135A, 136A can be referred to inner horizontal holes. As described in another manner, the inner vertical holes 138A can be disposed between the outer vertical holes 139A in a longitudinal direction (e.g., along line A2). In some implementations, the outer vertical holes 139A can be disposed between rows of holes 134A and 136A. The rows of holes 134A, 137A can be referred to outer horizontal holes.

In some implementations, the horizontal rows of holes 134A, 135A, 136A, and 137A are each larger than each of the vertical holes 138A, 139A. For example, each of the horizontal rows of holes 134A, 135A, 136A, and 137A may have a diameter of 12.75 mm and each of the vertical holes 138A, 139A may have a diameter of 5 mm. Other diameter sizes may be employed besides the one described herein. In some implementations, a hole size of the horizontal rows of holes 134A, 135A, 136A, 137A may be different than a hole size of the vertical holes 138A, 139A. For example, the horizontal rows of holes 134A, 135A, 136A, 137A may have a hole size that is at least two times bigger (e.g., two times in area) than the hole size of the vertical holes 138A, 139A. In some implementations, a ratio of the hole size of the horizontal row of holes and vertical holes can be greater than 2:1 (e.g., 3:1, 4:1, or so forth).

In some implementations, the vertical holes 138A, 139A are duplicated on an opposite side of the stove 100 (so that the vertical hole pattern is on only two sides of the stove 100). In some implementations, the horizontal holes 136A, 137A are duplicated on an opposite side of the stove 100 (so that these horizontal rows are on only two sides of the stove 100). In some implementations, the horizontal row of holes 134A, 135A are duplicated on all four sides of the stove 100 (so that the vertical hole pattern is on four sides of the stove 100).

The horizontal row 134A is a top row of the horizontal row and can function as an exhaust set of holes during operation of the stove 100. The horizontal row 135A can also function as an exhaust set of holes during operation of the stove 100. The horizontal rows 136A, 137A can function as a combustion set of holes during operation of the stove 100.

In some implementations, one or more pins (or sets of pins) (not shown) can be inserted in one or more of the vertical holes 138A, 139A. In such implementations, a device, (e.g., burner (e.g., a trangia burner)), fuel, and/or so forth can be supported by the one or more pins disposed within one or more of the vertical holes 138A, 139A.

For implementations of the stove 100 having a different shape (e.g., a cylindrical shape), the holes can be included in a different fashion within the main portion 130. For example, if the stove 100 is in the shape of a cylinder, the horizontal rows of holes can be arranged around the cylinder. The vertical holes can be located on opposite sides of the cylinder.

As shown in FIG. 1C, the stove 100 includes openings 141B, 141D. One or more of the openings 141B, 141D can be an opening through which fuel (e.g., a fuel stick, a fuel disc, a fire starter (e.g., paraffin wax starter)) can be inserted during operation of the stove. The opening 141D is somewhat hidden in this view. One or more of the openings 141B, 141D can be an opening through which a waste can be retrieved during operation of the stove. Combustion air can also be received through one or more of the openings 141B, 141D. Because the openings 141B, 141D are elevated due to the main portion 130 being disposed on the second cover 120, one or more pieces of fuel can be at an upward angle through the openings 141B, 141D. Although illustrated on opposite sides of the stove 100, the openings 141B, 141D can be configured to be on adjacent panels (e.g., sides of the main portion 130) of the stove 100.

In some implementations, an edge of the openings 141B, 141D may be at least curved (e.g., bent, rolled) to reduce sharp edges and/or irregular surfaces of the openings 141B, 141D. In some implementations, the curved edges of the openings 141B, 141D may add strength to the one or more portions of the main portion 130.

In some implementations, the openings 141B, 141D may include an edge trim (not shown) to protect the openings 141B, 141D. The edge trim may be made from various materials that are fire retardant. For example, such materials may be made from plastic, rubber, and metal tape.

FIG. 1D is a diagram that illustrates a cross-sectional view of the stove 100 in the first deployed configuration cut along line A2 shown in FIG. 1C. As shown in FIG. 1D, the second cover 120 is rotated (e.g., turned upside down) and the second end portion 132 of the main portion 130 is disposed in the recess 123 on the surface 122 of the second cover 120.

FIG. 1E is a diagram that illustrates a cross-sectional view of the stove 100 in the stowed configuration cut along line A1 shown in FIG. 1A. As shown in FIG. 1E, the first end portion 131 of the main portion 130 is disposed in the cavity 111 of the first cover 110 and the second end portion 132 of the main portion 130 is disposed in the cavity 121 of the second cover 120.

FIG. 1F illustrates a second deployed configuration of the stove 100 in accordance with another example implementation. As shown in FIG. 1F, in the second deployed configuration, the second cover 120 is rotated so that the cavity 121 is facing in an upward direction toward the main portion 130. The end portion 132 (which cannot be seen in this view) of the main portion 130 can be in disposed within the cavity 121. In this implementation, the recess 123 is facing in a downward direction away from the main portion 130. In the second deployed configuration, an item to be heated can be disposed above the main portion 130 (e.g., disposed on the main portion 130).

As shown in FIG. 1F, the horizontal rows of holes 134A, 135A (in the end portion 131) are exposed. The two rows of holes 136A, 137A are covered by the second cover 120 and are disposed within the cavity 121. The inner vertical holes 138A are exposed. A portion of the outer vertical holes 139A are covered by the second cover 120 and are disposed within the cavity 121. The holes covered by the second cover 120 may reduce the combustion of fuel during operation of the stove 100. In addition, the openings 141B, 141D may also be covered by the second cover 120 and may be disposed within the cavity 121.

The horizontal row 134A is a top row of the horizontal row and can function as an exhaust set of holes during operation of the stove 100 in this second configuration. The horizontal rows 135A can function as a combustion set of holes during operation of the stove 100 in this second configuration.

In the second configuration, fuel (e.g., fuel discs, a fuel stick, a fire starter (e.g., paraffin wax starter)), a burner (e.g., a trangia burner) can be used to provide heat during operation of the stove 100 especially in view of the openings 141B, 141D not being accessible. For example, one or more fuel discs can be burned in the main portion 130 of the stove 100. In some implementations, one or more fuel discs (e.g., 5 fuel discs) can be stored in the main portion 130 of the stove 100 (e.g., when in the stowed configuration).

FIG. 1G is a diagram that illustrates a cross-sectional view of the stove 100 in the first deployed configuration cut along line A3 shown in FIG. 1F. As shown in FIG. 1G, the second end portion 132 of the main portion 130 is disposed inside of the cavity 121 of the second cover 120. In this configuration, some of the holes (e.g., two rows of holes 135A, 137A, and outer vertical holes 139A) and the openings 141B, 141D are covered by the second cover 120.

FIG. 1H illustrates the main portion 130 of the stove 100. As shown in FIG. 1H, all of the edges of the main portion 130 are at least rolled or bent (i.e., curved) to, for example, reduce sharp edges.

FIG. 1I illustrates the second cover 120 of the stove. As shown in FIG. 1I, similarly all of the edges of the second cover 120 are at least rolled or bent (i.e., curved) to reduce sharp edges. As mentioned above, in some implementations, the first cover 110 can be identical to the second cover 120 (and can be interchangeable with the second cover 120 in function).

FIG. 1J is a diagram that illustrates a variation of the deployed configuration shown in FIGS. 1C and 1D. As shown in FIG. 1J, the first and second covers 110, 120 can be stacked. This configuration provides a taller stove 100 and allows the user to operate the stove 100 without bending or reaching for an item off the stove 100. The second cover 120 is coupled to the main portion 130 as shown in FIGS. 1C and 1D, however, the first cover 110 is coupled below the second cover 120. In other words, the second cover 120 (or at least a portion thereof) is disposed between the main portion 130 and first cover 110.

In this implementation, the first cover 110 and the second cover 120 are rotated (e.g., turned upside down) so that the cavities 111, 121 are facing in a downward direction away from the main portion 130. In other words, the recess 123 of the second cover 120 and the recess 113 of the first cover 110 are facing in an upward direction toward the main portion 130.

In some implementations, a perimeter edge 138 of the main portion 130 may disposed in (e.g., fit within) at least a portion of the recess 123 of the second cover 120. Further, the second cover 120 can be configured so that the cavity 121 of the second cover 120 can be disposed over at least a portion of the recess 113 of the first cover 110. Accordingly, the first cover 110 can be engaged with the second cover 120 (as shown in FIG. 1J) or engaged with the main portion 130 (as shown in FIG. 1A). In some implementations, the recess 113 of the first cover 110 can be the same size (in surface area) as the recess 123 of the second cover 120.

Figure 1K:
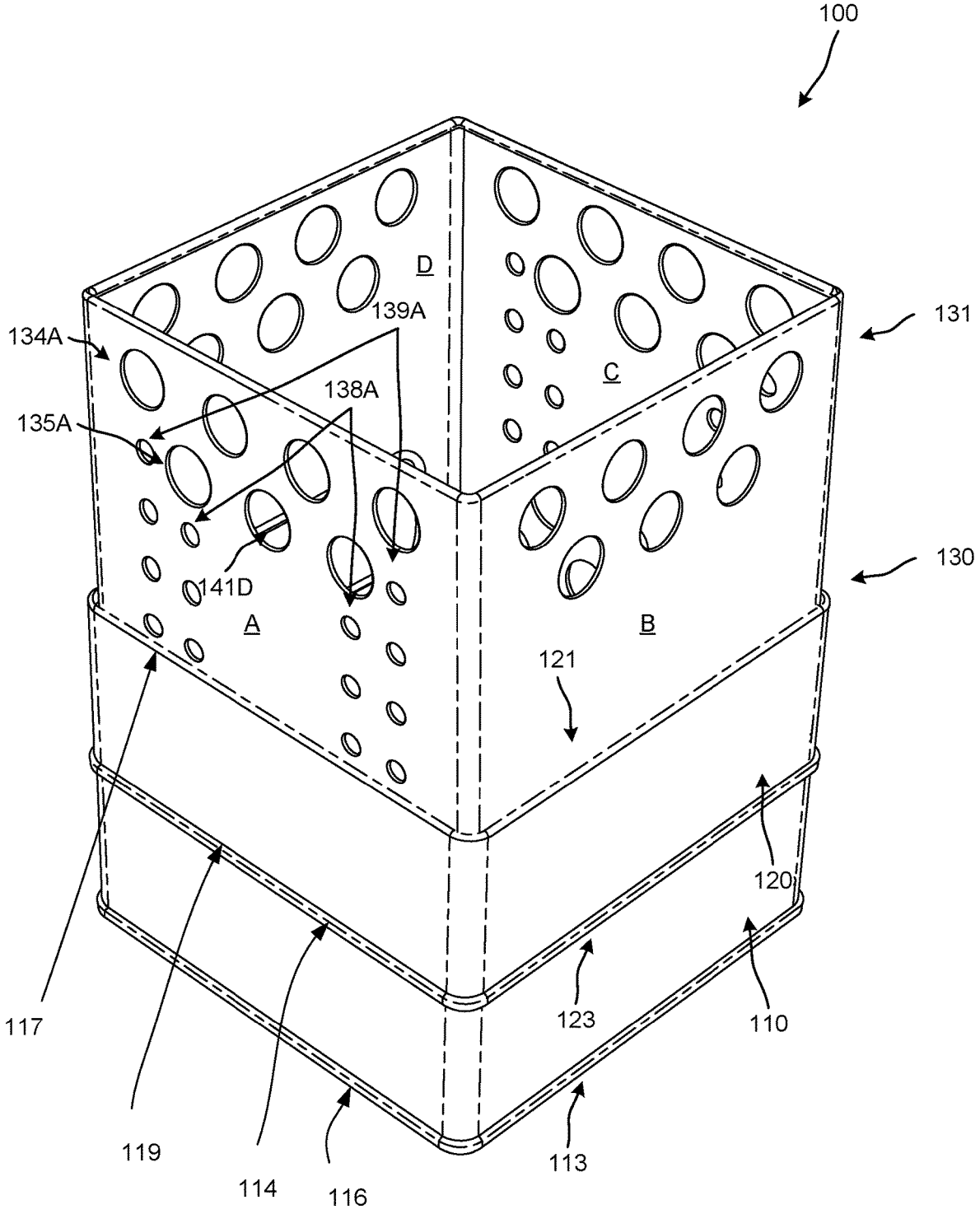
FIG. 1K is a diagram that illustrates another variation of the stove in the deployed configuration according to another example implementation.

FIG. 1K is a diagram that illustrates another variation of the deployed configuration shown in FIGS. 1F and 1G. As shown in FIG. 1K, the first and second covers 110, 120 can be stacked. The second cover 120 is coupled to the main portion 130 as shown in FIGS. 1F and 1G, however, the first cover 110 is coupled below the second cover 120. In other words, the second cover 120 (or at least a portion thereof) is disposed between the main portion 130 and first cover 110.

In this implementation, the first cover 110 has a portion (e.g., a top portion) disposed in the recess 123 of the second cover 120. Accordingly, the recess 123 of the second cover 120 and a recess 113 of the first cover 110 are facing in a downward direction away from the main portion 130.

In some implementations, the recess 123 of the second cover 120 can fit over a perimeter edge end 114 of the first cover 110 so that the perimeter edge end 114 of the first cover 110 can be disposed in at least a portion of the recess 123. In such implementations, the first cover 110 can be configured so that the cavity 111 of the first cover 110 can be disposed over at least a portion of the main portion 130. Accordingly, the first cover 110 can be engaged with the second cover 120 (as shown in FIG. 1K) or engaged with the main portion 130 (as shown in FIG. 1A). In some implementations, the recess 123 of the second cover 120 can be the same size (in surface area) as the recess 113.

Figure 2C:
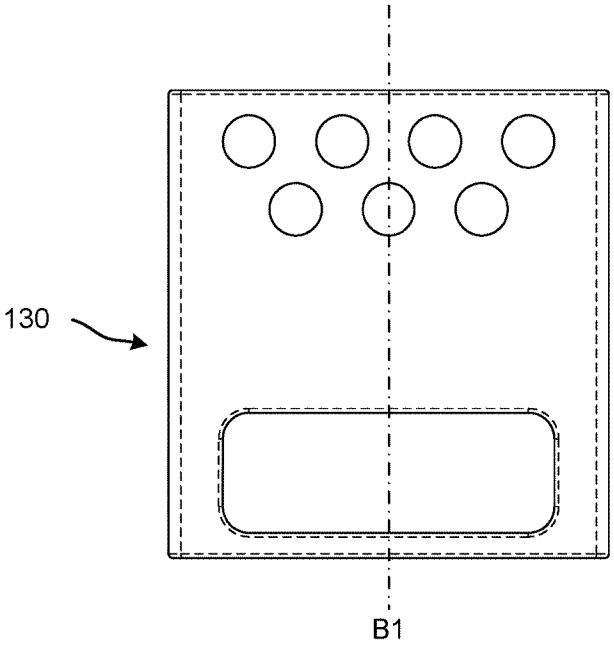
FIGS. 2A through 2F illustrates various view of a main portion of the stove.
Figure 2B:
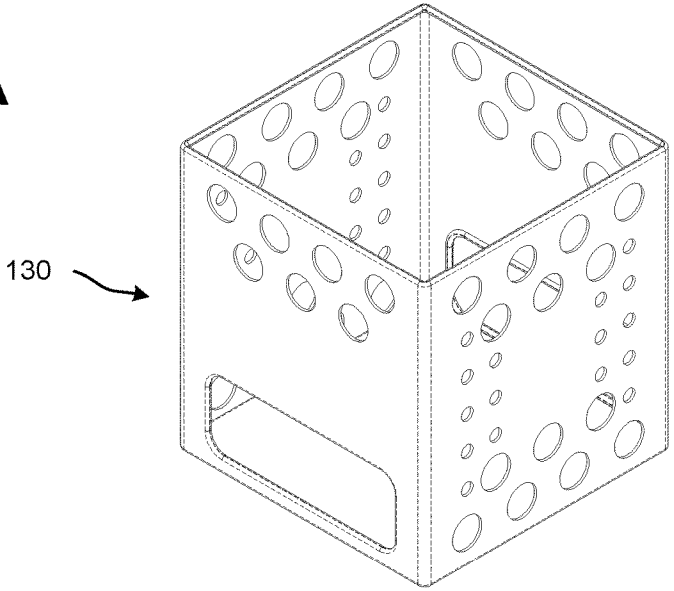
Figure 2A:
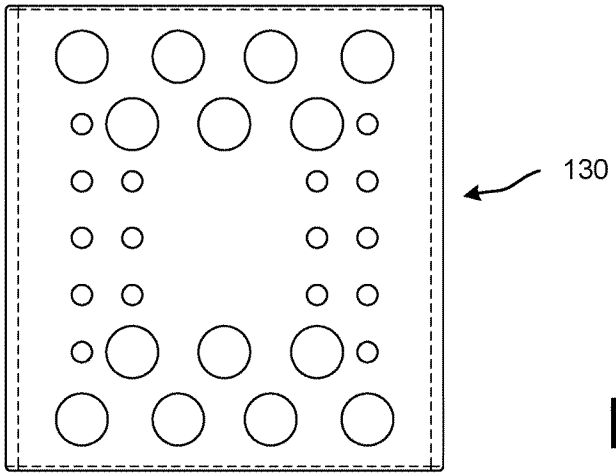
Figure 2F:
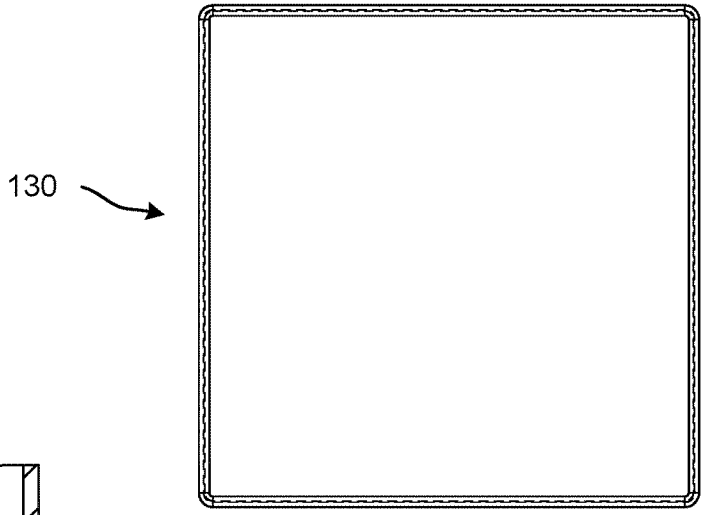
Figure 2E:
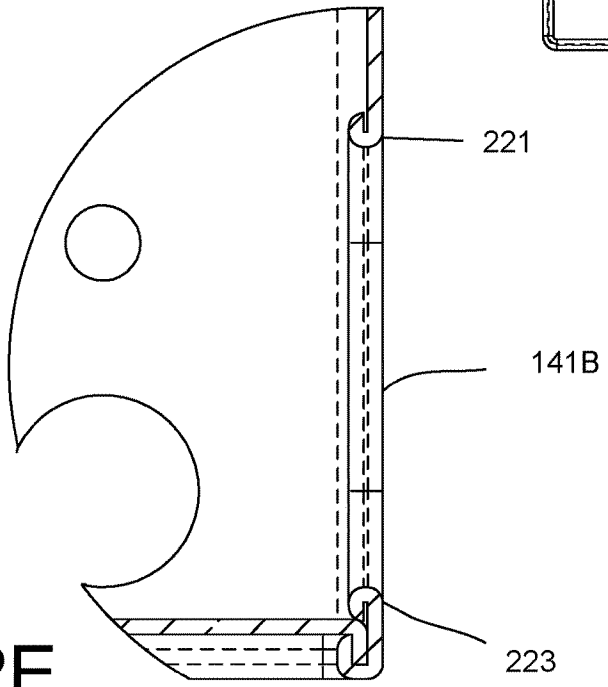
Figure 2D:
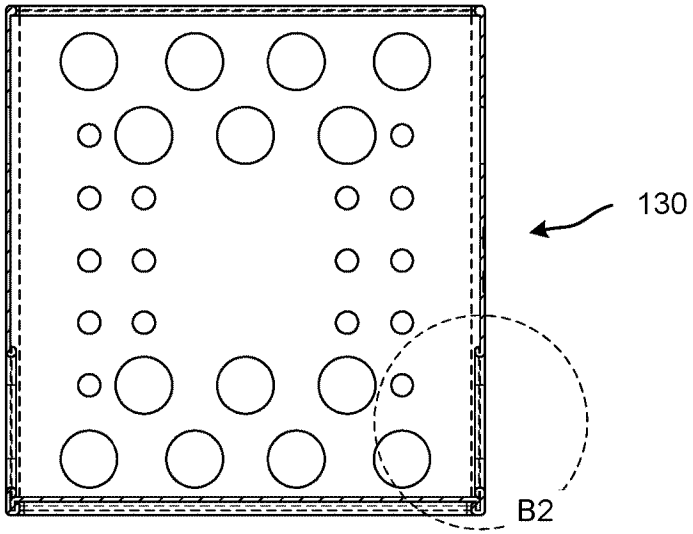

FIGS. 2A through 2F illustrates various view of a main portion 130 of the stove 100. Not all of the parts of the main portion 130 are labeled in these views. FIG. 2B illustrates a top view or bottom view of the main portion 130. FIG. 2D illustrates a cross-sectional view of the main portion 130 cut along line B1 shown in FIG. 2C. FIG. 2E illustrates a zoomed in view of portion B2 from FIG. 2D. FIG. 2E illustrates the ways in which the material of the stove 100 can be rolled or bent to provide strength for the components (e.g., edges, corners, etc.) of the main portion 130. For example, one end (e.g., top edge) of the main portion 130 may be rolled forming a rolled edge. In some implementations, the opening 141B may include edges 221 and 223, which may be bent to form a smooth edge (e.g., avert sharp edge).

Figure 3B:
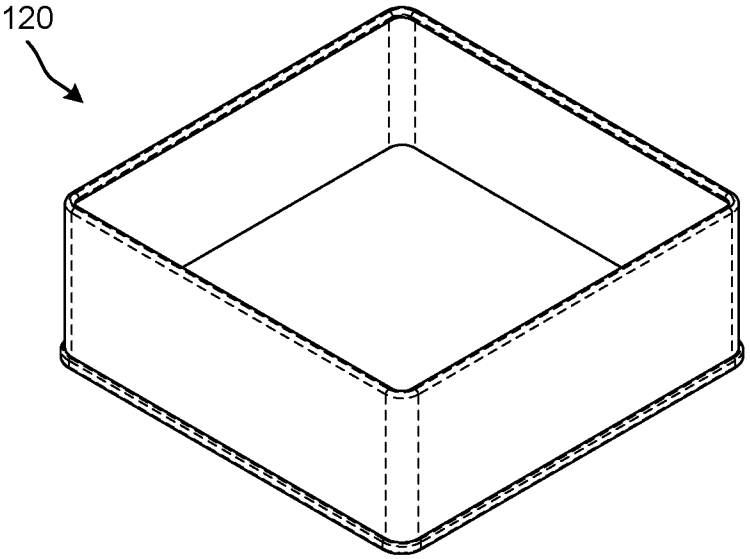
FIGS. 3A through 3E illustrates various view of a second cover of the stove.
Figure 3A:
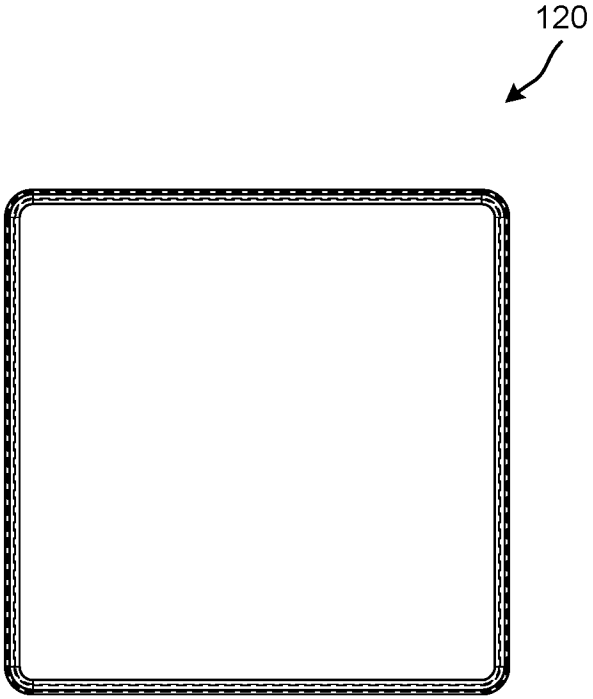
Figure 3E:
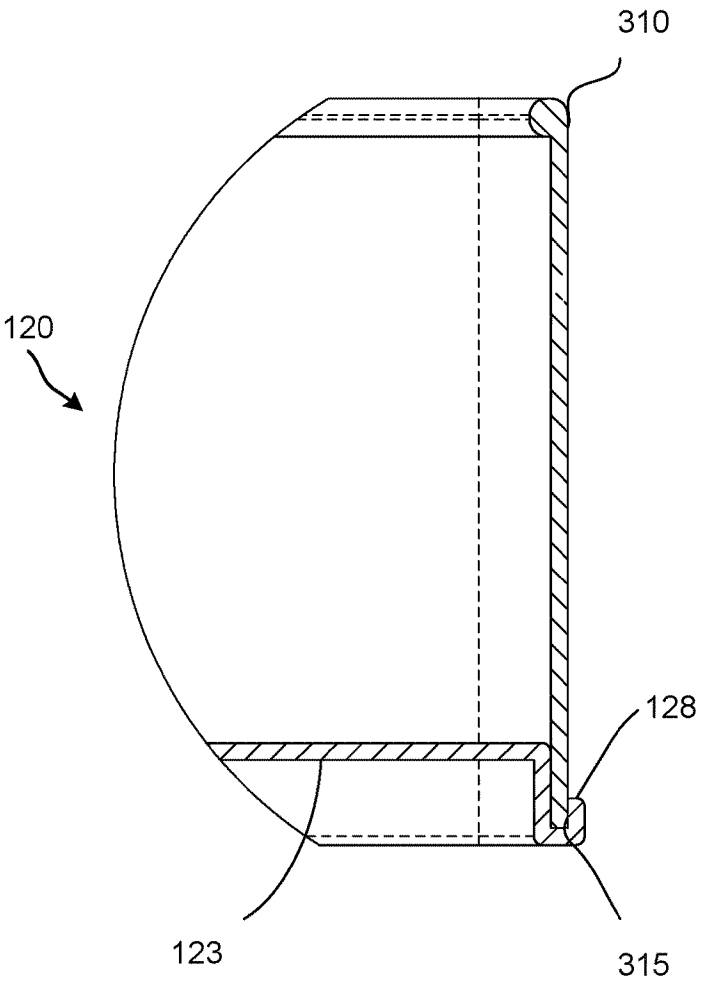
Figure 3C:
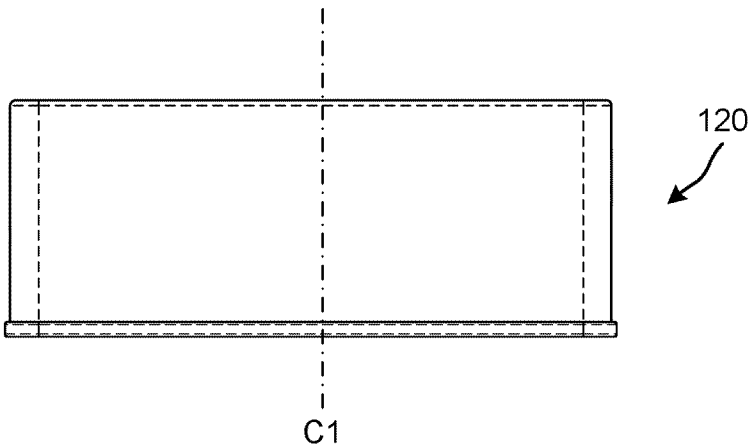
Figure 3D:
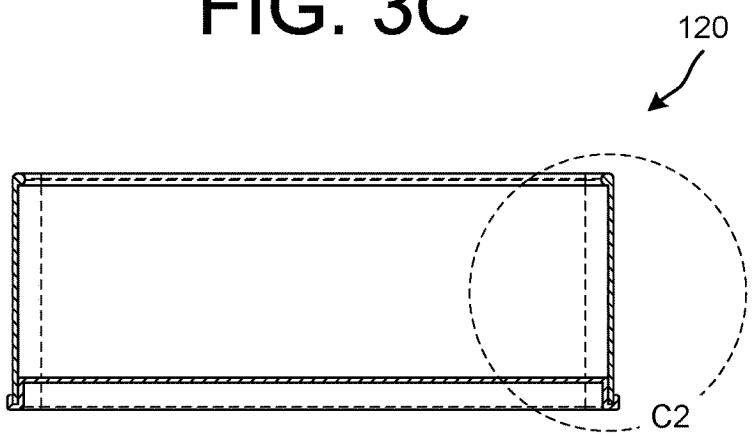

FIGS. 3A through 3E illustrates various view of a second cover 120 of the stove 100. Not all of the parts of the second cover 120 are labeled in these views. FIG. 3A illustrates a top view of the second cover 120. FIG. 3D illustrates a cross-sectional view of the second cover 120 cut along line C1 shown in FIG. 3C. FIG. 3E illustrates a zoomed in view of portion C2 from FIG. 2D. FIG. 3E illustrates the ways in which the material of the stove 100 can be rolled or bent to provide strength for the components (e.g., edges, corners, etc.) of the second cover 120.

For example, one end 310 (i.e., top edge forming the cavity) of the second cover 120 may be rolled forming a rolled edge. The other end 315, opposite the one end 310, may be disposed near the recess 123. In other words, end edges of the material forming the recess 123 may be bent to form a slot 128 such that the other end 315 of the second cover 120 may be attached to a portion of the recess 123 (e.g., placed inside of the slot 128). The other end 315 of the second cover 120 may be attached to the portion of the recess 123 by various methods, such as, welding, spot welding, riveting, brazing, soldering, glue, or adhesive.

The terminology used herein is for the purpose of describing particular implementations only and is not intended to be limiting of the implementations. As used herein, the singular forms "a," "an," and "the" are intended to include the plural forms as well, unless the context clearly indicates otherwise. It will be further understood that the terms "comprises," "comprising," "includes," and/or "including," when used in this specification, specify the presence of the stated features, steps, operations, elements, and/or components, but do not preclude the presence or addition of one or more other features, steps, operations, elements, components, and/or groups thereof.

It will also be understood that when an element, such as a layer, a region, or a substrate, is referred to as being on, connected to, electrically connected to, coupled to, or electrically coupled to another element, it may be directly on, connected or coupled to the other element, or one or more intervening elements may be present. In contrast, when an element is referred to as being directly on, directly connected to or directly coupled to another element or layer, there are no intervening elements or layers present. Although the terms directly on, directly connected to, or directly coupled to may not be used throughout the detailed description, elements that are shown as being directly on, directly connected or directly coupled can be referred to as such. The claims of the application may be amended to recite exemplary relationships described in the specification or shown in the figures.

As used in this specification, a singular form may, unless definitely indicating a particular case in terms of the context, include a plural form. Spatially relative terms (e.g., over, above, upper, under, beneath, below, lower, and so forth) are intended to encompass different orientations of the device in use or operation in addition to the orientation depicted in the figures. In some implementations, the relative terms above and below can, respectively, include vertically above and vertically below. In some implementations, the term adjacent can include laterally adjacent to or horizontally adjacent to.

Example implementations of the present inventive concepts are described herein with reference to cross-sectional illustrations that are schematic illustrations of idealized implementations (and intermediate structures) of example implementations. As such, variations from the shapes of the illustrations as a result, for example, of manufacturing techniques and/or tolerances, are to be expected. Thus, example implementations of the present inventive concepts should not be construed as limited to the particular shapes of regions illustrated herein but are to include deviations in shapes that result, for example, from manufacturing. Accordingly, the regions illustrated in the figures are schematic in nature and their shapes are not intended to illustrate the actual shape of a region of a device and are not intended to limit the scope of example implementations.

It will be understood that although the terms "first," "second," etc. may be used herein to describe various elements, these elements should not be limited by these terms. These terms are only used to distinguish one element from another. Thus, a "first" element could be termed a "second" element without departing from the teachings of the present implementations.

Unless otherwise defined, all terms (including technical and scientific terms) used herein have the same meaning as commonly understood by one of ordinary skill in the art to which this present inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

What is claimed is:

1. A stove, comprising:

a first cover including a cavity;

a second cover including a cavity; and a main portion including a first end portion and a second end portion, the first end portion defining a first opening and the second end portion defining a second opening, the main portion including a horizontal row of holes in the first end portion and a horizontal row of holes in the second end portion, in a stowed configuration, the first end portion of the main portion being disposed in the cavity of the first cover and the second end portion of the main portion being disposed in the cavity of the second cover, in a deployed configuration, the second end portion of the main portion being disposed in the cavity of the second cover such that the second cover entirely covers the horizontal row of holes in the second end portion, the main portion having a portion exposed outside of the first cover and the second cover when in the stowed configuration and in the deployed configuration, wherein two sides of the main portion, which are on opposite sides of the main portion, each include a vertical row of holes.

2. The stove of claim 1, further comprising:

a plurality of holes in the second end portion, the plurality of holes in the first and second end portions being horizontal rows of holes, the horizontal rows of holes being disposed on each of a first side, a second side, a third side and a fourth side of the main portion.

3. The stove of claim 1, wherein the main portion includes at least one opening through which fuel can be inserted during operation of the stove.

4. The stove of claim 3, wherein, in the deployed configuration, the second cover is configured to cover the at least one opening.

5. The stove of claim 1, wherein the second cover includes a recess, the recess being on an opposite side of the cavity of the second cover, the recess facing in a downward direction away from the main portion.

6. The stove of claim 5, wherein the recess and the cavity of the second cover have a common wall.

7. The stove of claim 1, wherein the main portion further includes a vertical column of holes, and in the deployed configuration, the second cover covers at least a portion of the vertical column of holes.

8. The stove of claim 1, wherein the main portion includes at least one opening through which fuel can be inserted during operation of the stove, and in the deployed configuration, the second cover covers the at least one opening.

9. The stove of claim 1, wherein, in the deployed configuration, the first cover is stacked below the second cover.

10. The stove of claim 1, wherein:

the first cover further includes a recess on an opposite side of the first cover relative to the cavity; and the second cover further includes a recess on an opposite side of the second cover relative to the cavity.

11. The stove of claim 10, wherein the first end portion of the main portion includes a first horizontal row of holes and a second horizontal row of holes, the first horizontal row of holes functioning as an exhaust set of holes during operation of the stove.

12. The stove of claim 10, wherein the first end portion of the main portion includes a first horizontal row of holes and a second horizontal row of holes, the second horizontal row of holes being below the first horizontal row of holes, the second horizontal row of holes functioning as a combustion set of holes during operation of the stove.

13. A stove, comprising:

a first cover including a cavity;

a second cover including a cavity; and a main portion including a first end portion and a second end portion, the first end portion defining a first opening and the second end portion defining a second opening, the main portion including a horizontal row of holes in the first end portion and a horizontal row of holes in the second end portion, in a stowed configuration, the first end portion of the main portion being disposed in and enclosed within the cavity of the first cover and the second end portion of the main portion being disposed in and enclosed within the cavity of the second cover, in a deployed configuration, the second end portion of the main portion being disposed in the cavity of the second cover such that the second cover entirely covers the horizontal row of holes in the second end portion, and in a deployed configuration, the horizontal row of holes in the first end portion being exposed outside of the second cover, the main portion including a plurality of holes arranged in columns of inner vertical holes and columns of outer vertical holes, the columns of inner vertical holes being arranged between the columns of outer vertical holes, a hole size of each of the horizontal row of holes being at least two times larger than a hole size of each of the outer vertical holes.

14. The stove of claim 13, wherein the first opening defined by the first end portion is uncovered when in the deployed configuration.

15. The stove of claim 13, wherein the horizontal row of holes in the first end portion includes a first horizontal row of holes and a second horizontal row of holes, at least one of the first horizontal row of holes or the second horizontal row of holes functions as an exhaust set of holes during operation of the stove.

16. The stove of claim 13, wherein the horizontal row of holes in the first end portion includes a first horizontal row of holes and a second horizontal row of holes, at least one of the first horizontal row of holes or the second horizontal row of holes functions as a combustion set of holes during operation of the stove.

17. A stove, comprising:

a first cover including a cavity;

a second cover including a cavity;

a main portion including a first end portion and a second end portion, the first end portion defining a first opening and the second end portion defining a second opening, the main portion including a horizontal row of holes in the first end portion and a horizontal row of holes in the second end portion; and a plurality of holes in the second end portion, the plurality of holes in the first and second end portions being horizontal rows of holes, the horizontal rows of holes being disposed on each of a first side, a second side, a third side and a fourth side of the main portion, in a stowed configuration, the first end portion of the main portion being disposed in the cavity of the first cover and the second end portion of the main portion being disposed in the cavity of the second cover, in a deployed configuration, the second end portion of the main portion being disposed in the cavity of the second cover such that the second cover entirely covers the horizontal row of holes in the second end portion, the main portion having a portion exposed outside of the first cover and the second cover when in the stowed configuration and in the deployed configuration.

18. The stove of claim 17, wherein the main portion includes a plurality of holes arranged in columns of inner vertical holes and columns of outer vertical holes, the columns of inner vertical holes being arranged between the columns of outer vertical holes.

19. The stove of claim 18, wherein a hole size of each of the horizontal row of holes is at least two times larger than a hole size of each of the outer vertical holes.

20. The stove of claim 17, wherein two sides of the main portion, which are on opposite sides of the main portion, each include a vertical row of holes.

* * * * *